US010165840B2

(12) United States Patent
Adams, I

(10) Patent No.: US 10,165,840 B2
(45) Date of Patent: Jan. 1, 2019

(54) LOCKING FASTENER SYSTEM

(71) Applicant: Amika Adams, I, Belleville, MI (US)

(72) Inventor: Amika Adams, I, Belleville, MI (US)

( * ) Notice: Subject to any disclaimer, the term of this patent is extended or adjusted under 35 U.S.C. 154(b) by 57 days.

(21) Appl. No.: 15/424,828

(22) Filed: Feb. 4, 2017

(65) Prior Publication Data

US 2018/0220764 A1 Aug. 9, 2018

(51) Int. Cl.

| | |
|---|---|
| ***A45C 13/12*** | (2006.01) |
| ***A45C 13/10*** | (2006.01) |
| ***A44B 99/00*** | (2010.01) |
| ***A41F 1/00*** | (2006.01) |
| ***A45C 13/30*** | (2006.01) |
| *A45C 3/06* | (2006.01) |

(52) U.S. Cl.

CPC ..... *A45C 13/126* (2013.01); *A41F 1/002* (2013.01); *A44B 99/005* (2013.01); *A45C 13/1069* (2013.01); *A45C 13/30* (2013.01); *A45C 3/06* (2013.01); *Y10T 24/32* (2015.01)

(58) Field of Classification Search

CPC ... A45C 13/126; A45C 13/30; A45C 13/1069; A41F 1/002; A44B 99/005; A44D 2203/00

USPC ..... 24/303, 265 R

See application file for complete search history.

(56) References Cited

U.S. PATENT DOCUMENTS

| | | | | |
|---|---|---|---|---|
| 3,052,462 | A | 9/1962 | Butler | |
| 3,146,982 | A | 9/1964 | Budnick | |
| 3,194,524 | A | 7/1965 | Trumbull | |
| 3,516,631 | A | 6/1970 | Santucci | |
| 4,121,324 | A * | 10/1978 | Marbacher | A41F 1/002 24/303 |
| 4,665,592 | A | 5/1987 | Kasai | |
| 5,438,736 | A | 8/1995 | Terada et al. | |
| 5,588,188 | A | 12/1996 | Jermyn, Jr. | |
| 5,634,246 | A | 6/1997 | Jermyn, Jr. | |
| 5,906,031 | A | 5/1999 | Jensen | |
| 6,032,339 | A * | 3/2000 | D'Addario | A45C 13/1092 24/265 BC |
| 2004/0190237 | A1* | 9/2004 | Yang | A45C 13/30 361/679.55 |
| 2004/0206430 | A1* | 10/2004 | Chang | A45C 3/06 150/110 |
| 2007/0028429 | A1* | 2/2007 | Ishida | A45C 13/1069 24/303 |
| 2011/0035910 | A1* | 2/2011 | Wu | F16M 11/10 24/303 |

* cited by examiner

*Primary Examiner* — Robert Sandy
*Assistant Examiner* — Rowland Do
(74) *Attorney, Agent, or Firm* — Wayne State Law School Patent Clinic

(57) ABSTRACT

A fastener system that provides the ability to attach objects together. The fastener system includes a key and a housing, which connect together by insertion of a prong and a magnetic attachment. The key includes a prong that fits into a recess at a center point. The housing includes an aperture at the lower end to allow attachment to an item, and a slot at the upper end to receive insertion of the key.

8 Claims, 2 Drawing Sheets

LOCKING FASTENER SYSTEM

BACKGROUND OF THE INVENTION

1. Field of the Invention

The present invention related to a fastener having features that allows for detachment and customization of items to suit the owners' style and needs. More specifically, the present invention relates to a fastener system that provides a locking method by magnet to allow customization of items only using the fastener system.

2. Description of the Related Art

In general, attachments occur by hooks. These hooks vary in size and may swivel but are so common to allow goods from differing manufacturers to be attached to each other. Thus, generic or substituted goods may be attached to an item, which reduces the ability for a manufacturer to be the only provider of customizations for their goods. Therefore, there is a need for customization of attachment to allow for designers to customize what is attached to their goods.

BRIEF SUMMARY OF THE INVENTION

The present invention relates to a locking fastener system. In one embodiment of the present invention is a two-piece locking fastener system which comprises a fastener key and a fastener housing.

The key comprises an elongated body with two ends: an insertion end and an outer end. Further, the key has two sides: a locking-direction side and an unlocking-direction side. A prong is located at the insertion end of the key, for mating with the housing. One embodiment of the key comprises the key made of a magnetic material. An additional embodiment of the key features a magnet fixed to the locking-direction side of the key. The housing comprises an upper end and a lower end. The upper end has a slot for insertion of the key. The slot has a center point and a recess at the center point. In one embodiment would have the recess dimensioned to accept insertion of the prong of the key.

The slot has each an unlocking location and a locking location. The width of the slot varies from a first width at the unlocking location to a second width at the locking location. The first width at the unlocking location is dimensioned to allow insertion of the key. One embodiment would have a width, which would equate to the sum of the thickness of the key's body and prong height. The second width at the locking location is dimensioned to secure the key when the prong of the key is inserted into the center point recess. In one embodiment of the second width at the locking location is just larger than the width of the key's body.

The locking location has a magnet to provide attraction between the key and the housing, providing the locking of the mechanism.

The key is inserted into the housing at the unlocking location, the prong is seated in the recess of the housing, and the key is rotated through the slot to the locking location.

An additional embodiment further comprises an aperture on the lower end of the housing. This aperture would allow for attachment of the housing to a strap or bag.

An additional embodiment further comprises an aperture on the outer end of the key. This aperture would allow for attachment of the key to a strap or bag.

An additional embodiment would comprise the above, but further comprise an alignment element protruding from the locking direction side of the key. The housing in this embodiment would further comprise a recess at the locking location to allow for mating with the alignment element of the key.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
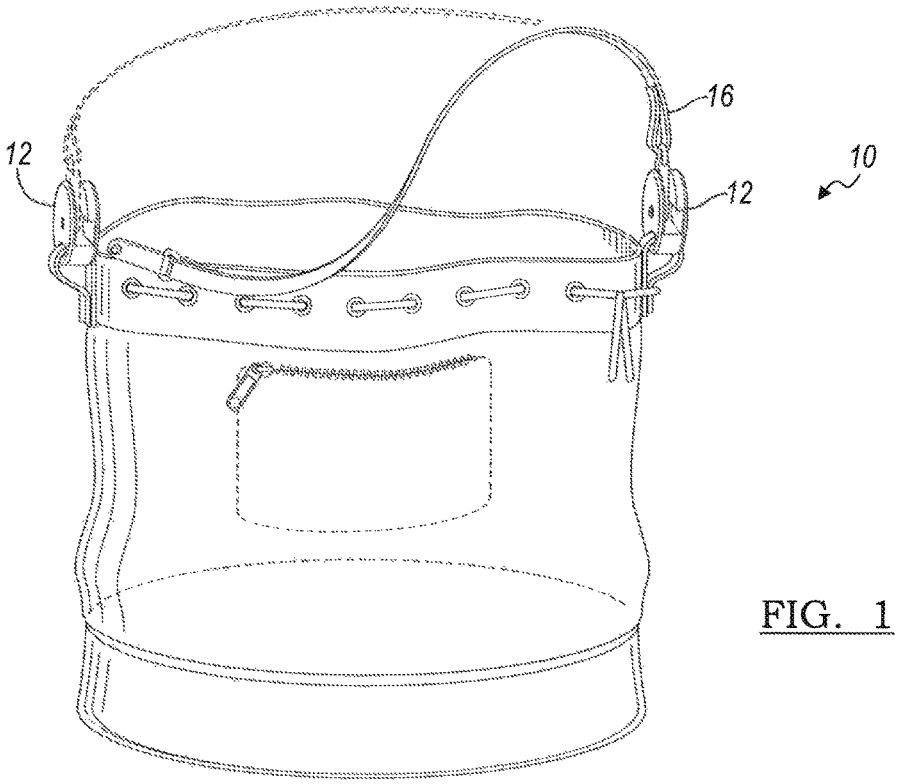
FIG. 1 is an overall view of a potential embodiment of the present invention to attach a strap to a purse or bag.
Figure 2:
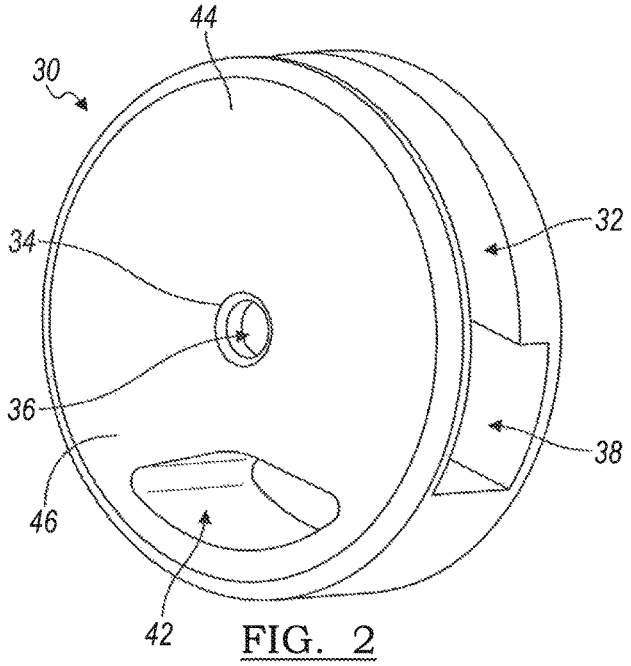
FIG. 2 is an enlarged view of the housing component of one embodiment of the present invention.
Figure 3:
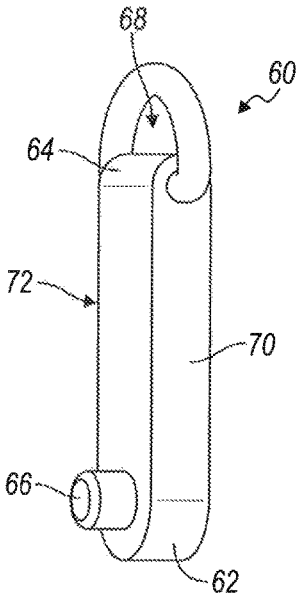
FIG. 3 is an enlarged view of the key component of one embodiment of the present invention.

The present invention relates to a locking fastener system with one embodiment which allows a manufacturer to provide exclusive customization for what can be attached to their products. The fastener allows for items of differing designs and customizations that are only provided by the manufacturer. The embodiments of the present invention may be used to attach to any item requiring an attachment though in this embodiment the present invention is used in connection with attaching a strap to a bag. The embodiments of the present invention may be attached on an item and include different customized parts that may be interchangeable.

One embodiment of the present invention is shown in FIGS. 1-6. A fastener system (12) is attached to a bag (10) and a strap (16). The fastener system (12) includes a housing (30) shown in FIG. 2, the components of which are described below.

In one embodiment, the housing (30) may contain a slot (32) at the upper end (44), an aperture (42) in the lower end (46), the center point (34), and the recess of center point (36). The upper end (44) may include a slot (32) with an unlocking location (38) and a locking location (40) to allow insertion of a key (60). The aperture (42) of one embodiment is for attachment to a strap or bag, and is not required for other embodiments of the present invention.

Figure 4:
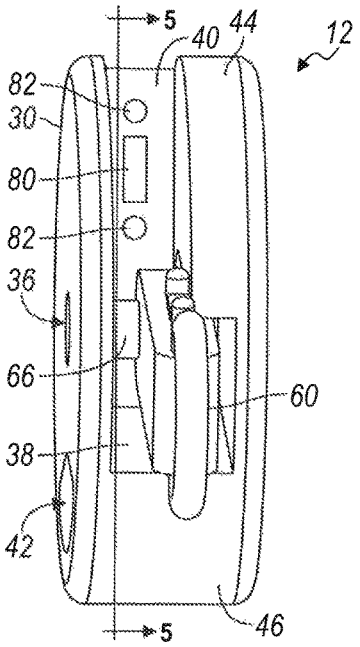
FIG. 4 is a side view of one embodiment, where the key shown in FIG. 3 is located at the unlocking location in the housing shown in FIG. 2.

The fastener system (12) may contain a key (60), which is inserted into the housing (30) as shown in FIG. 4, the components of which are described below.

In one embodiment, the key (60) may contain an insertion end (62) and an outer end (64). The prong (66) is located at the insertion end (62) and an aperture on the outer end (68). The prong (66) further consists of an unlocking-direction side (70) and a locking-direction side (72). The key (60) may also include alignment elements (84) on the locking direction side (72). The aperture (68) of one embodiment can be for attachment to a strap or bag, and is not required for other embodiments of the present invention.

Figure 5:
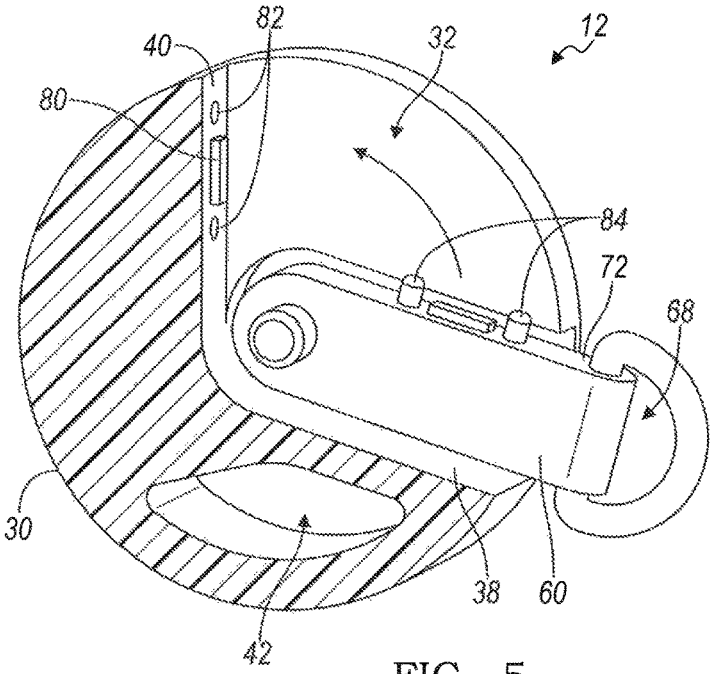
FIG. 5 is a cross-section view of one embodiment shown in FIG. 4.
Figure 6:
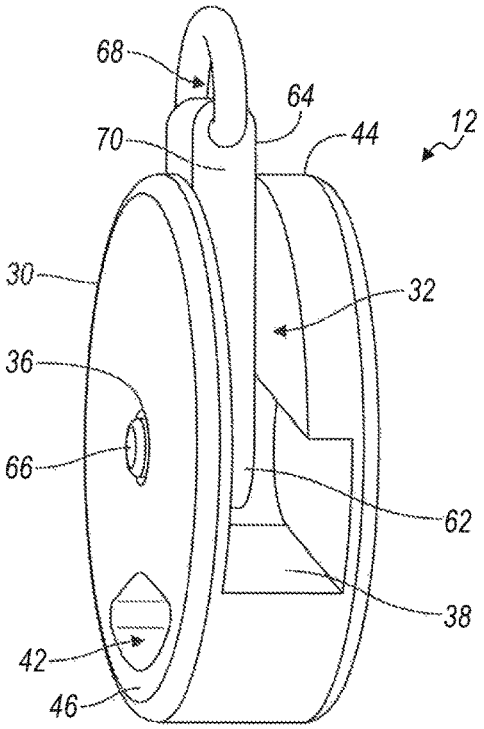
FIG. 6 is a side view of one embodiment, where the key shown in FIG. 3 is rotated to the locking location in the housing shown in FIG. 2.

The housing (30) may contain a slot (32), which allows for insertion of the key (60) as shown in FIG. 5, the components of which are described below.

The width of the slot (32) varies from the unlocking location (38) to the locking location (40). The width at the unlocking location (38) is dimensioned to allow insertion of the key (60). In one embodiment, the width of the slot at the unlocking location (38) is slightly larger than the sum of the thickness of the key's body (60) and prong height (66). The second width at the locking location (40) is dimensioned to secure the key when the prong (66) is inserted into the center point recess (36). In one embodiment, the width at the locking location (40) is slightly larger than the width of the key (60).

In one embodiment, the key (60) may be inserted into the slot (32) at the unlocking location (38), which allows the prong (66) to be inserted into the center point recess (36). The insertion of the prong (66) in the center point recess (36) provides the first constraint between the housing (30) and the key (60). Further, the prong (66) in the center point recess (36) provides a rotational center for the key (60) as it rotates into the locking location (40). FIG. 5 is a cross-section of one embodiment, showing the rotational aspect of the key (60). The locking location (40) of the slot (32) and the locking-direction side (72) of the key (60) each contain a magnet (80). The two magnets (80) attract to each other, providing a locking function between the key (60) and the housing (30) of the mechanism. The key (60) is rotated towards the locking location (40), where it is secured in place by the magnet (80). In the preferred embodiment, the slot (32) contains a recess for insertion of an alignment element (82), which attaches to the alignment element (84) of the key (60). This provides an additional constraint of movement between the housing (30) and the key (60) when in the locked position.

While this description discloses one embodiment of the present invention, those skilled in the art could make modifications and variations without departing from the spirit and scope of the invention described in the claims.

What is claimed:

1. A fastener system, comprising:

a key having an elongated body with an insertion end with a magnetic prong, and an opposing outer end; and a housing having an upper end and a lower end, and said upper end having a slot for insertion of said key, the slot having an unlocking location with a magnet for engaging with the prong and a locking location;

the slot having a width that varies from a first width at the unlocking location and a second width at the locking location, the first width at the unlocking location dimensioned to accommodate insertion of the key, and the second width at the locking location dimensioned to secure the key following rotation of the key from the unlocking location towards the locking location;

the slot having a center point with a recess having a diameter to fit to the prong of the key, the recess having a depth for insertion of said prong at the center point to allow the key to rotate from the unlocking location towards the locking location while the prong is in the recess.

2. The fastener system as described in claim 1, wherein the key further comprises:

an aperture at the outer end of the key for attachment of a strap or bag.

3. The fastener system as described in claim 1, wherein the key further comprises:

a locking-direction side and an unlocking-direction side, an alignment element protruding from the locking direction side to mate with the housing.

4. The fastener system as described in claim 1, wherein the key further comprises:

a locking-direction side and an unlocking-direction side, an alignment element protruding from the locking direction side to mate with the housing, an aperture at the outer end of the key for attachment of a strap or bag.

5. A housing for receiving a key as part of a fastener system, comprising:

an upper end and a lower end, and said upper end having a slot configured for insertion of a key having a prong, the slot having an unlocking location and a locking location;

the slot having a first width at the unlocking location and a second width at the locking location;

the first width configured to accommodate insertion of the key, and the second width configured to secure the key following rotation of the key from the unlocking location towards the locking location;

the locking location having a magnet configured to provide attachment of the key to the housing; and the slot having a center point and a recess at the center point, the center point having a diameter configured to fit the prong of the key, and the recess having a dimension depth configured for insertion of the prong at the center point to allow the key to rotate from the unlocking location towards the locking location while the prong is in the recess.

6. The housing as described in claim 5, further comprising:

an aperture at the lower end of the housing configured to attach a strap or bag.

7. The housing as described in claim 5, further comprising:

a recess at the locking location configured to allow mating with an alignment element of the key.

8. The housing as described in claim 5, further comprising:

a recess at the locking location configured to allow mating with an alignment element of the key, and an aperture at the lower end of the housing configured to attach a strap or bag.

* * * * *